US005107783A

United States Patent [19]

Magazzù

[11] Patent Number: 5,107,783

[45] Date of Patent: Apr. 28, 1992

[54] VARIABLE TRIM TRIMARAN

[75] Inventor: Alfredo Magazzù, Palermo, Italy

[73] Assignee: Aeromarine S.r.l., Palermo, Italy

[21] Appl. No.: 686,394

[22] Filed: Apr. 17, 1991

[30] Foreign Application Priority Data

Apr. 26, 1990 [IT] Italy ..... 47890 A/90

[51] Int. Cl.[5] ..... B63B 43/14

[52] U.S. Cl. ..... 114/123; 114/61

[58] Field of Search ..... 114/61, 123, 273, 283

[56] References Cited

U.S. PATENT DOCUMENTS

| | | | |
|---|---|---|---|
| 1,917,446 | 7/1933 | Hitt | 114/273 |
| 3,068,830 | 12/1962 | Dickerson | 114/123 |
| 3,528,380 | 9/1970 | Yost . | |
| 3,871,317 | 3/1975 | Szpytman . | |
| 3,987,743 | 10/1976 | Pensel . | |
| 5,031,557 | 7/1991 | Farrier . | |

FOREIGN PATENT DOCUMENTS

| | | | |
|---|---|---|---|
| 2320466 | 11/1974 | Fed. Rep. of Germany | 114/123 |
| 1432295 | 2/1966 | France . | |
| 2135524 | 12/1972 | France . | |
| 1158613 | 2/1987 | Italy . | |
| 116699 | 5/1919 | United Kingdom . | |

*Primary Examiner*—Jesûs D. Sotelo

*Attorney, Agent, or Firm*—Beveridge, DeGrandi & Weilacher

[57] ABSTRACT

This invention relates to a variable trim trimaran in which side floats (2) are provided that are connected to the central hull (1) by means of devices (3, 5) that allow them to shift vertically, wherein a deck structure (4) is provided that is connected to the central hull (1) and is so shaped as to cover at the top portion said side floats (2), so that they come to belong in the general outline of the trimaran itself.

22 Claims, 4 Drawing Sheets

VARIABLE TRIM TRIMARAN

This invention relates to a variable trim trimaran.

More particularly, this invention relates to a boat of the kind mentioned above, which in addition to be provided with means for adjusting the vertical shift of the floats so as to control the rolling motions of the boat itself, also has some further structural and/or functional devices that improve remarkably both the conditions and the possibilities of employing the craft.

In a preceding Italian patent application filed in the name of Prof. Alfredo Magazzù, on Apr. 7th, 1982, No. 42012-A/82, granted on Feb. 18th 1987, No. 1158613, a particular trimaran structure is disclosed wherein the connection between the side floats and the central hull is capable of allowing the floats themselves to be shifted vertically by automatic, semiautomatic or by manual action.

Accordingly, the rolling motions of the boat as well as the increase in the dynamic stability of the craft are obtained, under the same conditions, with respect to a conventional trimaran.

The advantages stemming from the technical teachings of the patent mentioned above with respect to boats of that type already known, wich are endowed with floats that are connected rigidly to the central hull, can be put into evidence as follows:

even when the hull is at rest, its floats are dipped till they receive a thrust which is set forth previously and can be adjusted independently of the average draft and of the attitude of the central hull;

on increasing the speed of the craft, the hydrodynamic thrust generated by the floats themselves and/or the thrust given by any possible hydroplane fins present which are connected to the floats, causes the floats to be raised gradually and automatically (i.e., with no intervention on the pilot's part), so that the floats elude the hydrodynamic drag (partially in case they are finless or totally in case they are provided with fins), and this occurs independently of the draft of the central hull;

adjustments of the transverse attitude of the craft can be obtained through the differential adjustment of the float height, and this operation can be performed indifferently both when the boat is at rest and when it is in motion. The adjustment of the longitudinal attitude can also be obtained when the floats are fastened aft with respect to the central hull, as is normally suitable;

a significative increase in the overturning angle of the craft is obtained, and anyway a significant increase in the area subtended by the stability diagram, with the concomitant evident advantages as regards the dynamic stability (the work required to overturn the craft). This allows the float sizes to be reduced, under the same conditions, with respect to those required in the case of a conventional trimaran, with evident advantages in terms both of cost and of the motion drag, as well as of direct weight (the weight of the floats) and of indirect weight (lower stresses generated by the floats on the connecting structures and on the connections to the central hull);

an initial behavior of the stability diagram is obtained which is perfectly in agreement with the operating requirements and the comfort requirements of the craft, this holding true both when the boat is at rest and when it is in motion; moreover, such diagram can be modified at will, by means of simple regulations of the control gains in order to keep into account the possible operative changing needs which are in connection, for instance to different load conditions;

the almost complete elimination of the rolling oscillations is obtained on slight sea both when the boat is at rest and when it is in motion, this being a result of the remarkable controlling moments developed by the differential adjustment of the floats in comparison to the conventional antirolling fins employed on ships.

However, the trimaran of the patent mentioned above shows a number of drawbacks which are particularly evident in the practical application of that solution on boats intended for commercial activities, like the transportation of passengers or other activities that ask for frequent docking, or frequent approaching to other boats or, anyway, asks for manoeuvering in crowded harbors.

Indeed, the shape of the trimaran in question is somewhat not compact because of the presence of the side hulls (the floats) which come remarkably out of the general outline of the central hull, so that they are a remarkable encumbrance and obstacle during the operations mentioned above, because of the impossibility of taking the central hull, which is intended for housing people and/or materials to the approach zones.

Moreover, the structure of the central hull which is necessarily narrow and subtle does not allow passengers and/or goods to be housed in the best way.

In case of collision, the severe damage to one of the side floats and/or the damage to one of the articulated arms connecting the central hull and the floats and/or the damage to the systems that drive the floats compromise the lateral stability of the craft completely, and this can make it impossible, apart from the objective seriousness of the problem, to obtain the certification by the authorities if the craft is to be employed for commercial purposes and, in particular, for the public transportation of passengers.

As a consequence, in spite of all advantages that the solution offered by the cited patent gives with respect to the prior art, a craft realized in that way is not competitive with respect to the craft employed at present.

The main object of the present invention is that of realizing a trimaran whose floats are adjustable, according to what is already known from the patent mentioned above, said trimaran having a number of innovations of functional and structural character which can obviate all drawbacks mentioned above.

Accordingly, a first object of the present invention is that of realizing a trimaran wherein the central hull has a deck which is capable of receiving the floats and of protecting them as a consequence in case of collision.

It is a further object of the present invention the realization of a trimaran whose adjustable floats are so constructed as to compromise in a non-determinant way the stability of the craft in case of breaking and/or damaging of one of them.

It is a further object of the present invention the realization of a trimaran provided with a dampening device of the pitch motion.

Accordingly, it is a specific object of the present invention a variable trim trimaran which is provided with side floats connected to the central hull through devices which allow them to shift vertically, wherein a deck structure is provided which is connected to the central hull and is so shaped as to cover at the top said side floats so that they are caused to belong in the general outline of the trimaran itself.

In particular, such deck structure can be so realized as to be integral with the central hull or as to be separate from the same and connected structurally to it.

The connection between side floats and the central hull can be realized by means of connection members which are rigidly connected to the floats and hinged to the central hull, and by means of devices for changing automatically and/or manually and/or passively the attitude, like pneumatic hydraulic cylinders, hydropneumatic cylinders and so on, which can be controlled by adjustment and/or control systems of any kind.

According to the present invention, said devices for changing automatically and/or manually and/or passively the attitude of the floats can be provided between the floats and the central hull or between the floats and the deck structure.

Further according to the present invention the floats are connected to the central hull by means of a plurality of connection members.

Moreover, a plurality of devices can be provided for automatically and/or passively changing the attitude of the floats, whose number can be equal to or lower than the number of the connection members.

Again according to the present invention, the single floats can be realized by means of total or partial foaming and/or by means of subdivision into watertight compartments.

According to a further embodiment of the trimaran of this invention, two or more pairs of floats will be provided, each one being connected to the central hull according to one of the solutions disclosed above.

In order to improve on the control of the pitching motions, a hydrodynamic fin can be provided according to the present invention, said fin being arranged at the bow of the central hull, which fin can be deflected totally in the active or the passive mode, in particular through a control device connected to sensors of the vertical direction and/or of attitude and/or of pitching velocity and/or of pitching acceleration, or said fin can be deflected partially by means of flaps or the like.

This invention will be disclosed in the following according to some preferred embodiments of the same with particular reference to the enclosed drawings wherein.

Figure 1:
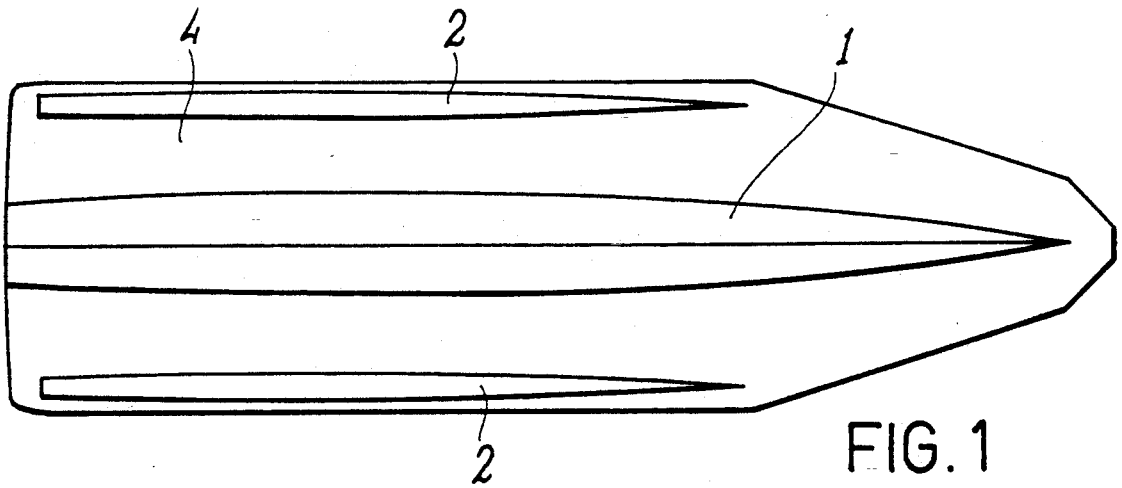
FIG. 1 is a schematic bottom view of a first embodiment of the trimaran according to the present invention.
Figure 2:
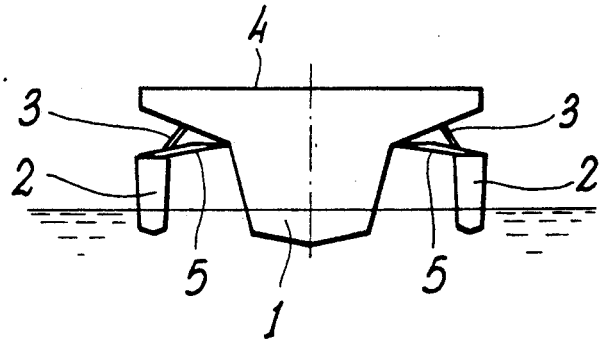
FIG. 2 is a front view of the trimaran of FIG. 1.

With reference now to FIGS. 1 and 2, a trimaran is shown which is provided with a central hull 1 and with two floats 2, connected to the central hull by means of hydraulic cylinders 3 and the connections 5.

The central hull 1 is provided with a deck 4 that extends over both sides of the hull 1, so covering the floats 2 which thus come to belong in the whole outline of the trimaran.

As it would be impossible to realize such structural compactness of the trimaran if the floats 2 are of the adjustable attitude type by merely connecting the hull 1 and the floats 2 through a rigid deck, the solution disclosed herein allows the floats 2 to be independent for the base structure so that they are free of rising and lowering according to the automatic control logics, or in the passive mode and, at the same time, it is possible to avoid risks stemming from the damage of said floats 2 in case of approach or of docking.

Figure 3:
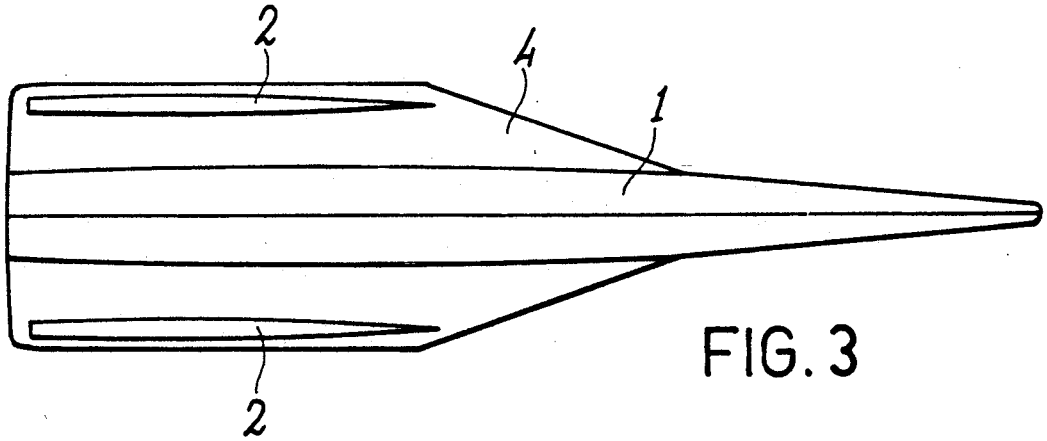
FIG. 3 is a schematic bottom view of a second embodiment of the trimaran according to this invention.

The solution suggested in FIG. 3 is substantially similar to that disclosed with reference to FIGS. 1 and 2, with the only difference that the central hull 1 comes out of the deck 4 at the front position.

The deck 4 can be so realized as to be completely integral with the central hull 1 or to be separate from the same and structurally connected to it.

Figure 4:
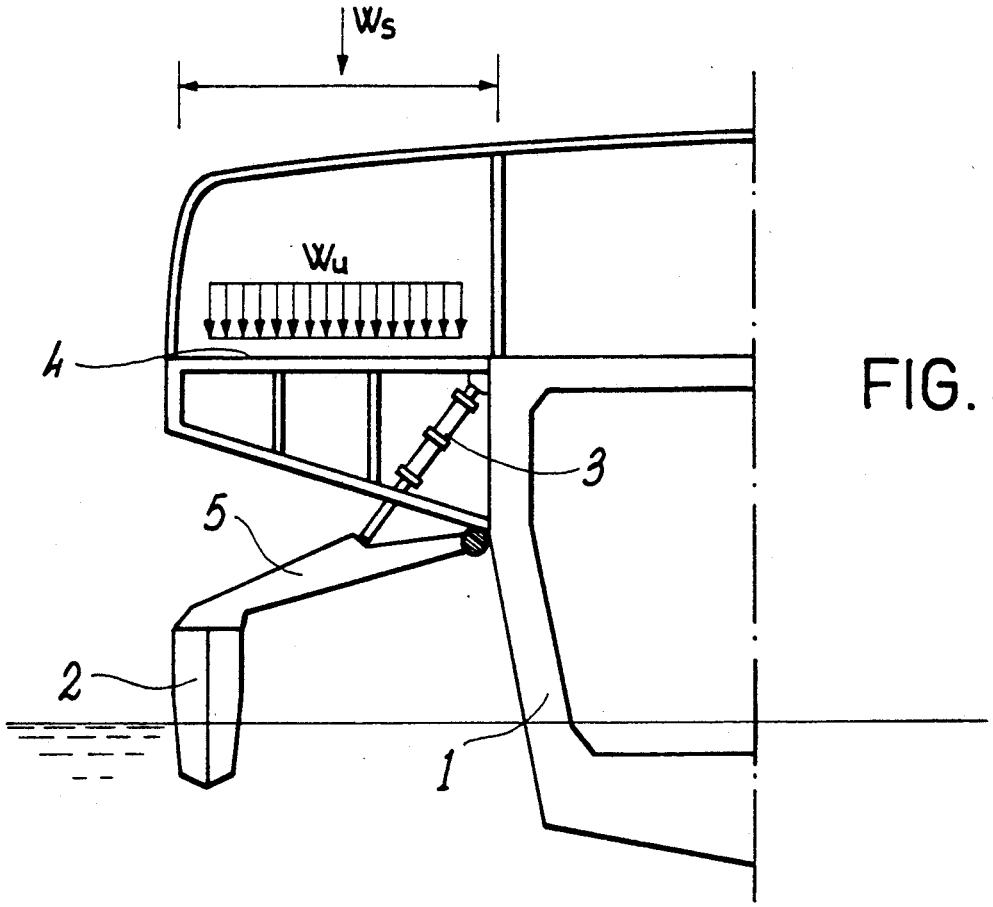
FIG. 4 shows a detail of an embodiment of the trimaran according to the present invention.

For instance, the solution shown in FIG. 4 allows the realization, from the structural viewpoint, of a hull beam which is capable of supporting the general stresses, in particular the flexural and the torsional stresses like those occurring in conventional hulls, with advantages in terms of weight, as the supporting structures of the deck 4 are just to be capable of supporting the local stresses, i.e. the stresses due to the superstructures or deckhouses (Ws) and of the carrying capacity (Wu).

Figure 5:
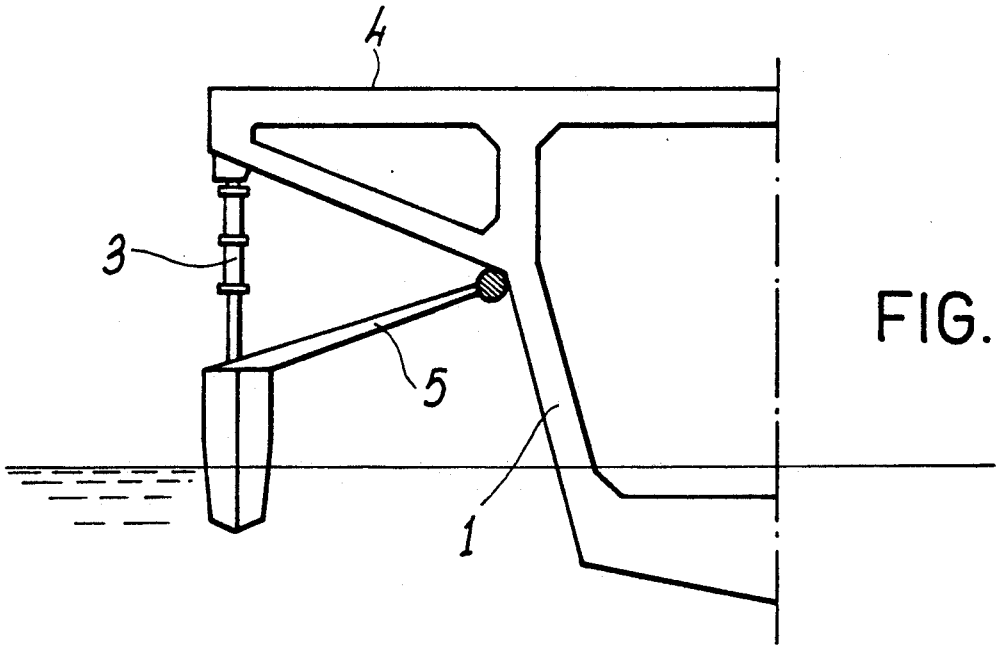
FIG. 5 shows a detail of a further embodiment of the trimaran according to this invention.

The structure shown in FIG. 5 is also to support the stresses caused by the cylinders 3 which are connected to the deck 4, whereas the float 2 is hinged to the hull 1 by means of the connecting member 5.

As shown in FIGS. 4 and 5, connecting member 5 is pivotably attached to hull 1 at an intersection location between an inwardly and downwardly sloping surface of deck structure 4 and to the central hull section. FIG. 4 also shows variable length connecting member 3 pivotably connected to the hull at an intersection location between an upper planar member of the deck structure and an upper region of the central hull section.

The result obtained is a boat which on the whole is lighter than the traditional boats of equal length and width, but the structural strength of such boat is at least equivalent to that of the traditional ones because, as already mentioned above, the supporting structures of the enlarged deck are not a part of the hull beam and do not take part in the general stresses.

Moreover, as the boats are smaller than those of the traditional trimarans, the technique of connecting them directly to the deck 4 through the cylinders 3 gives rise to stresses in the deck 4 itself which are definitely reduced with respect to those of the normal floats.

Figure 6:
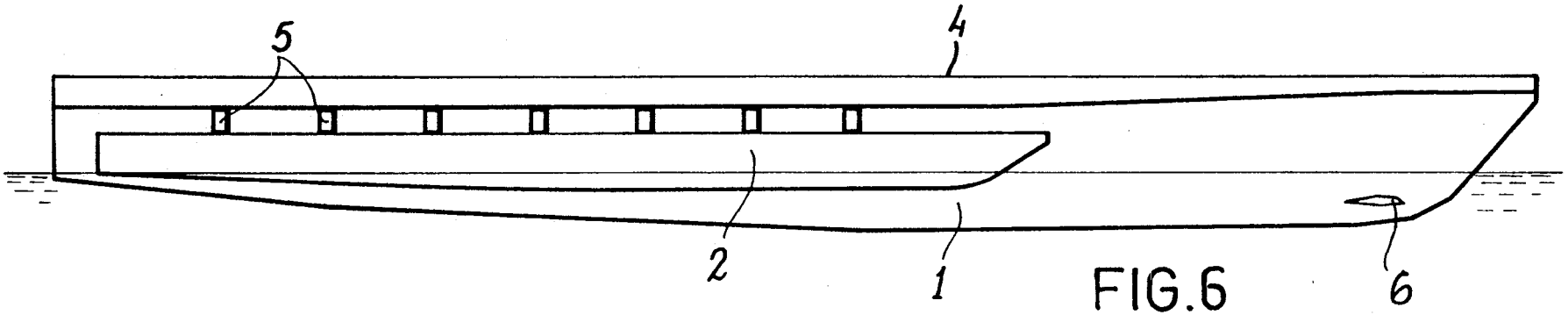
FIG. 6 is a side view of a further embodiment of the trimaran according to this invention.
Figure 7:
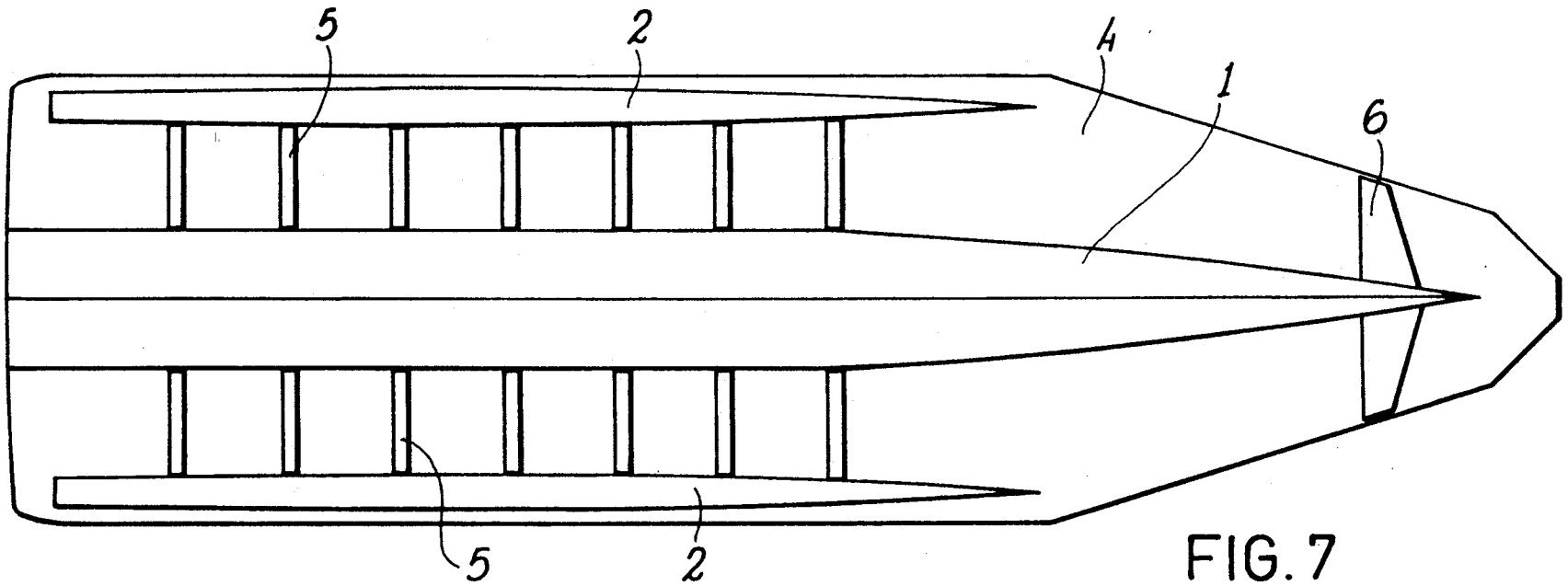
FIG. 7 is a bottom view of the trimaran of FIG. 6.

In order to prevent the damage of the connecting member 5 of a float 2 to the hull 1 in case of collision from compromising in a determinant way the stability of said trimaran, the solution shown in FIGS. 6 and 7 can be adopted, wherein a redundant system of connections 5 of the floats 2 with the hull 1 is realized (see FIGS. 6 and 7).

Such redundancy can also be extended to said cylinders 3.

Moreover, each float 2 will be realized so as to be scarcely permeated by any possible water pathways caused by collisions or any other similar accidents, by foaming the floats 2 themselves totally or partially, or realizing them as watertight compartments.

Again FIGS. 6 and 7 show a system that allows the pitching motion of the craft to be dampened.

It is made up of a hydrodynamic fin 6 arranged forwards of the hull 1, said fin being capable of deflecting totally so as to generate counteracting moments which are suitable to reduce the pitching motions of the craft, thus integrating in said function also the action of the floats 2.

Figure 8:
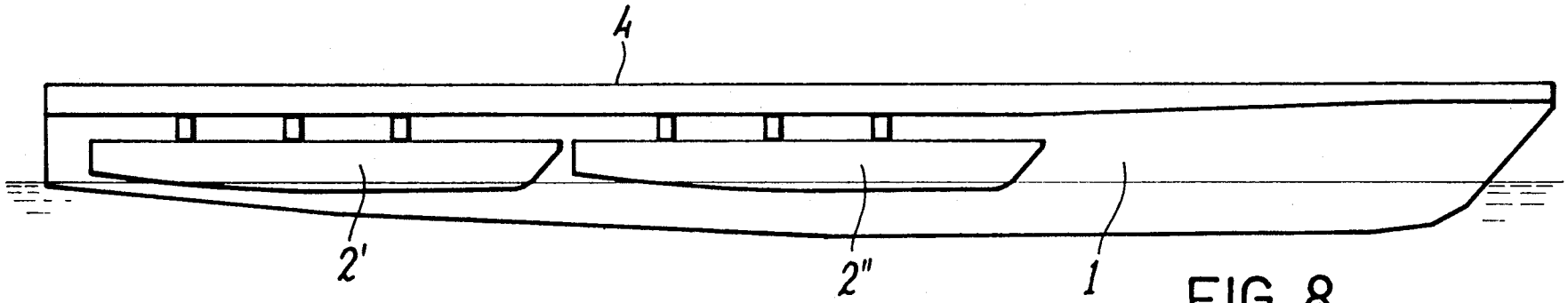
FIG. 8 is a side view of a further embodiment of the trimaran according to this invention.
Figure 9:
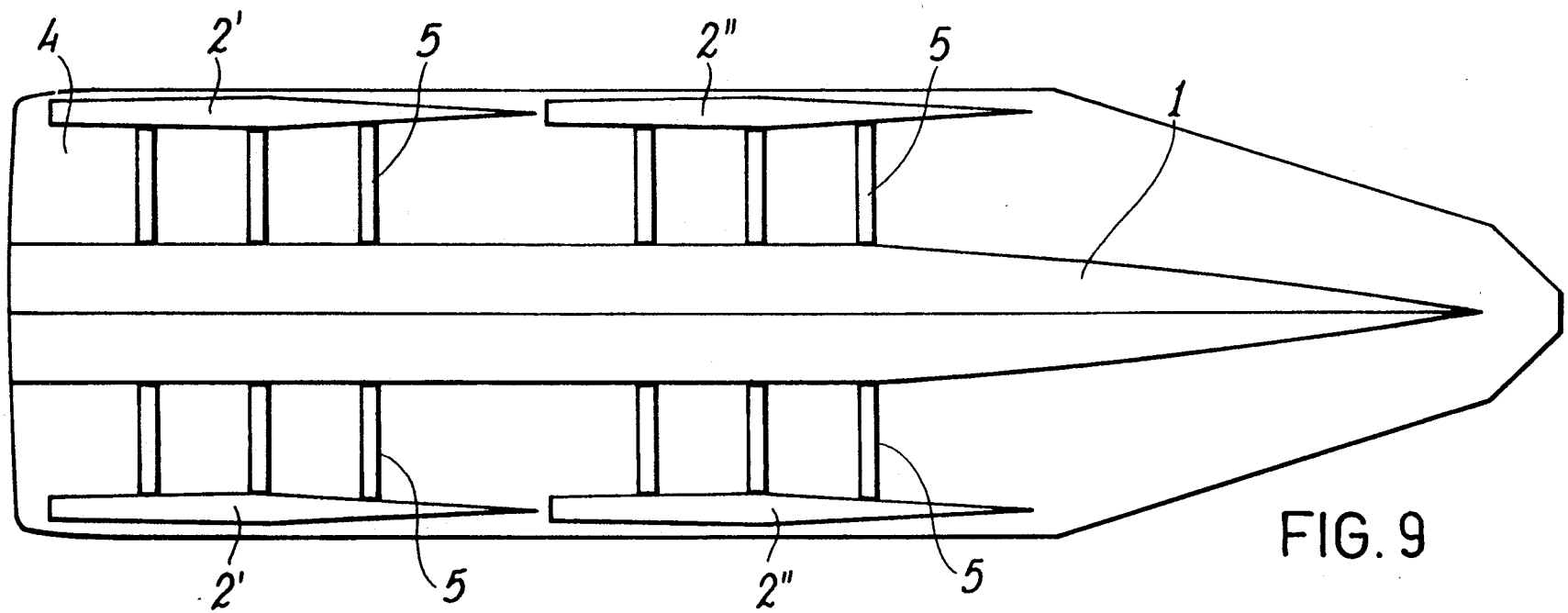
FIG. 9 is a bottom view of the trimaran of FIG. 8.

A further embodiment of the trimaran according to the present invention is that shown in FIGS. 8 and 9, wherein two pairs of floats 2' and 2'' are provided, each one being connected to the central hull 1 by a plurality of connections 5.

In such way, the safety coefficients of the solution shown in FIGS. 6 and 7 are further improved.

The pairs of floats 2' and 2'' can be employed for generating, in addition to the rolling motions obtained by lifting the floats of a given side and lowering the other ones or vice-versa, even the pitch moments, by lowering the forward floats and lifting the astern floats, or vice-versa, so obtaining changes in the longitudinal attitude and/or the dampening of the pitching oscillations.

The results as regards this feature are definitely better than those which can be obtained by means of a sigle pair of floats, which pair is usually arranged astern.

This invention has been disclosed with specific reference to some preferred embodiments of the same, but it is to be understood that modifications and/or changes can be introduced by those who are skilled in the art without departing from the spirit and scope of the invention for which a priority right is claimed.

I claim:

1. A variable trim trimaran, comprising:

a hull extending in a longitudinal direction, said hull including a deck structure and a central hull section which has a central longitudinal axis, said deck structure extending laterally on opposite sides of said central hull section to define lateral sides of said trimaran and said deck structure including first and second underlying surfaces which intersect with said central hull section on opposite sides of said deck structure to define first and second intersection locations;

a first float positioned to one side of said central hull section;

a second float positioned to another side of said central hull section;

first connecting means for connecting said first float to said hull such that said deck structure covers said first float, said first connecting means including a first connecting member which is variable in length and is secured at one end to said deck structure, and a second connecting member which extends from said first float and is pivotably attached at said first intersection location about a pivot axis extending essentially parallel with said central axis;

second connecting means for connecting said second float to said hull such that said deck structure covers said second float, said second connecting means including a third connecting member which is variable in length and is secured at one end to said deck structure, and a fourth connecting member which extends from said second float and is pivotably attached at said second intersection location about a second pivot axis extending essentially parallel with said central axis.

2. A trimaran as recited in claim 1 further comprising control means for controlling the attitude of said floats with respect to said deck structure by adjustment of the total length of said first third connecting members.

3. A trimaran as recited in claim 1 wherein said first connecting member has an opposite end which intersects with said second connecting member and wherein said third connecting member has an opposite end which intersects with said fourth connecting member.

4. A trimaran as recited in claim 3 wherein said first and second floats include an exterior surface having an outline which generally conforms with the lateral sides of said deck structure.

5. A trimaran as recited in claim 3 wherein said deck structure includes a first and a second upper member, extending to opposite sides of an upper region of said central hull, and said first and third connecting members are pivotably secured at intersection locations between said central hull and said first and second upper members.

6. A trimaran as recited in claim 3 wherein said first and third connecting member are vertically orientated and extend from said first and second floats, respectively.

7. A trimaran as recited in claim 3 wherein the opposite end of said first and third connecting member intersect said second and fourth connecting members, respectively, at a point along said second and fourth connecting members between a point of attachment with said hull and a point of attachment with a respective one of said floats.

8. A trimaran as recited in claim 1 wherein said first and second underlying surfaces extend downwardly and inwardly from a respective lateral side of said deck structure so as to intersect said central hull, said second connecting member being privotably connected with said hull at the intersection of the first downwardly and inwardly sloping surface and said central hull, and said foruth connecting member being pivotably connected with said hull at the intersection of said second downwardly and inwardly sloping surface and said central hull.

9. A trimaran as recited in claim 1 wherein said first and third connecting members include hydraulic suspension members.

10. A trimaran as recited in claim 9 further comprising passive control means for adjusting said hydraulic suspension members.

11. A trimaran as recited in claim 9 further comprising automatic control means for adjusting said hydraulic suspension members.

12. A trimaran as recited in claim 9 further comprising manual control means for adjusting said hydraulic suspension members.

13. A trimaran as recited in claim 1 further comprising a third float positioned aft of said first float and on the same side as said first float, and a fourth float positioned aft of said second float and on the same side as said second float, said trimaran further comprising third connecting means for independently connecting said third float to said central hull and fourth connecting means for independently connecting said fourth float to said central hull.

14. A variable trim trimaran, comprising;

a hull extending in a longitudinal direction, said hull including a deck structure and a central hull section which has a central longitudinal axis, said deck structure extending laterally on opposite sides of said central axis to define lateral sides of said trimaran;

a first float positioned to one side of said central hull section;

a second float positioned to another side of said central hull section;

first connecting means for connecting said first float to said hull such that said deck structure covers said first float, said first connecting means including a first connecting member which is variable in length and is secured at one end at a securement location on said deck structure, and a second connecting member which extends from said first float and is privotably attached to said hull about a pivot axis extending essentially parallel with said central axis, and said pivot axis lying below a horizontal plane extending through the securement location of said first connecting member with said deck structure;

second connecting means for connecting said second float to said hull such that said deck structure covers said second float, said second connecting means including a third connecting member which is variable in length and is secured at one end at a securement location on said deck structure, and a fourth connecting member which extends from said second float and is pivotably attached to said hull about a second pivot axis extending essentially parallel with said central axis, and said second pivot axis lying below a horizontal plane extending through the securement location of said third connecting member with said deck structure, and said first and third connecting members being directly attached to said central hull section and extending away from said central hull section.

15. A trimaran as recited in claim 14 wherein said first and second floats include an exterior surface having an outline which generally conforms with the lateral sides of said deck structure.

16. A trimaran as recited in claim 14 wherein said first connecting member has an opposite end which intersects with said second connecting member and wherein said third connnecting member has an opposite end which intersects with said fourth connecting member.

17. A trimaran as recited in claim 16, wherein said second and fourth connecting members are pivotably secured to said central hull.

18. A trimaran as recited in claim 16 wherein said central deck structure includes first and second underlying surfaces which extend downwardly and inwardly from a respective lateral side so as to intersect said central hull, said second connecting member being pivotably connected with said hull at the intersection of the first downwardly and inwardly sloping surface and said central hull, and said fourth connecting member being pivotably connected with said hull at the intersection of said second downwardly and inwardly sloping surface and said central hull.

19. A trimaran as recited in claim 18 wherein said first and third connecting members are pivotably secured to said central hull at a location where a planar member of said deck structure intersects said central hull section.

20. A trimaran as recited in claim 18 wherein the opposite end of said first and third connecting members intersect said second and fourth connecting members, respectively, at a point along said second and fourth connecting members between a point of attachment with said hull and a point of attachment with a respective one of said floats.

21. A trimaran as recited in claim 14 wherein said first and third connecting members include hydraulic suspension means.

22. A trimaran as recited in claim 14 further comprising a hydrodynamic fin assembly extending laterally to opposite sides of a front end portion of said central hull.

* * * * *